US010658789B1

(12) United States Patent
Wang et al.

(10) Patent No.: US 10,658,789 B1
(45) Date of Patent: May 19, 2020

(54) HIGH SPEED CONNECTOR WITH MAGNETIC ENGAGEMENT MECHANISM

(71) Applicant: AMPHENOL EAST ASIA ELECTRONIC TECHNOLOGY (SHEN ZHEN) CO., LTD., Shen Zhen, Guangdong Province (CN)

(72) Inventors: Xiang Wang, Shen Zhen (CN); Lei Liao, Shen Zhen (CN)

(73) Assignee: AMPHENOL EAST ASIA ELECTRONIC TECHNOLOG (SHEN ZHEN) CO., LTD., Shenzhen, Guangdong Province (CN)

( * ) Notice: Subject to any disclaimer, the term of this patent is extended or adjusted under 35 U.S.C. 154(b) by 0 days.

(21) Appl. No.: 16/524,803

(22) Filed: Jul. 29, 2019

(51) Int. Cl.
*H01R 13/62* (2006.01)
*H01R 12/70* (2011.01)
*H01R 107/00* (2006.01)

(52) U.S. Cl.
CPC ..... *H01R 13/6205* (2013.01); *H01R 12/7011* (2013.01); *H01R 2107/00* (2013.01)

(58) Field of Classification Search
CPC ..... H01R 13/6205; H01R 12/711; H01R 2107/00
See application file for complete search history.

(56) References Cited

U.S. PATENT DOCUMENTS 6,142,829 A * 11/2000 O'Groske ..... H01R 13/7195 439/620.08
7,311,526 B2 * 12/2007 Rohrbach ..... G06F 1/18 439/39
7,775,801 B2 * 8/2010 Shiff ..... H01R 13/6205 439/39
8,436,740 B2 * 5/2013 Ke ..... G06F 1/1656 340/654
8,535,088 B2 * 9/2013 Gao ..... H01R 9/03 439/490
9,017,092 B1 * 4/2015 McCracken ..... H01R 13/629 439/374
9,196,979 B2 * 11/2015 Kim ..... H01R 13/24
9,478,901 B2 * 10/2016 Chen ..... H01R 13/22
9,490,578 B2 * 11/2016 Wu ..... H01R 13/642
9,685,733 B2 * 6/2017 Zhao ..... H01R 13/6205
9,735,500 B2 * 8/2017 Magana ..... H01R 13/6205
9,893,451 B2 * 2/2018 Zhang ..... H01R 11/30
10,483,689 B2 * 11/2019 Lipke ..... H01R 13/6205
(Continued)

*Primary Examiner* — Briggitte R. Hammond
(74) *Attorney, Agent, or Firm* — Muncy, Geissler, Olds & Lowe, P.C.

(57) ABSTRACT

A high speed connector with magnetic engagement mechanism includes a cable end connector and a plate end connector combined with each other; the cable end connector having a cable end body member and a resilient pin connected with a cable; the plate end connector being on a PCB and having a plate end body member and a connection terminal; the cable end body member having a concave portion on a plug end of the cable end body member; the resilient pin being disposed in the concave portion; the plate end body member having a convex portion on a plug end of the plate end body member; the convex portion and a plane of the plug end of the plate end body member including a 20-degree angle. Therefore, the signal integrity is improved, and the safety issue due to an abnormal plugging is prevented.

2 Claims, 2 Drawing Sheets

(56) References Cited

U.S. PATENT DOCUMENTS

| | | | | |
|---|---|---|---|---|
| 2008/0050963 | A1* | 2/2008 | Shi | H01R 13/506<br>439/364 |
| 2014/0113461 | A1* | 4/2014 | Kim | H01R 13/6205<br>439/39 |
| 2015/0118868 | A1* | 4/2015 | Choi | H01R 11/30<br>439/39 |
| 2015/0188253 | A1* | 7/2015 | Tada | H01R 13/6205<br>439/39 |
| 2016/0093975 | A1* | 3/2016 | Katiyar | H01F 1/147<br>439/38 |
| 2016/0111815 | A1* | 4/2016 | Szeto | H01R 13/6205<br>439/39 |

* cited by examiner

HIGH SPEED CONNECTOR WITH MAGNETIC ENGAGEMENT MECHANISM

BACKGROUND OF THE INVENTION

1. Field of the Invention

The present invention relates to connectors, and more particularly, to a high speed connector with magnetic engagement mechanism.

2. Description of the Related Art

A conventional cable connector applies stamped terminals as the metal connection carriers. Under a high-speed signal transmission application, the signal integrity is easily lowered by the factors such as the effect of the antenna. Also, the plugging and unplugging operations are difficult to be carried out due a lower plugging tolerance.

SUMMARY OF THE INVENTION

For improving the current technical issues, a high speed connector with magnetic engagement mechanism is disclosed. With an optimized structure, the signal integrity deterioration and the low plugging tolerance of the conventional connector are improved.

For achieving the aforementioned objectives, the present invention provides a high speed connector with magnetic engagement mechanism, comprising: a cable end connector and a plate end connector; the cable end connector and the plate end connector being combined with each other; the cable end connector comprising a cable end body member and a resilient pin connected with a cable; the plate end connector being disposed on a PCB (printed circuit board) and comprising a plate end body member and a connection terminal; the cable end body member comprising a concave portion formed on a plug end of the cable end body member; the resilient pin being disposed in the concave portion; the plate end body member comprising a convex portion formed on a plug end of the plate end body member; the convex portion and a plane of the plug end of the plate end body member including a 20-degree angle; the connection terminal being disposed in the convex portion; when the cable end connector is combined with the plate end connector, the resilient pin is inserted into the connection terminal.

Preferably, the cable end connector of the high speed connector comprises a first magnetic member disposed on two sides of the concave portion, and the plate end connector comprises a second magnetic member disposed on two sides of the convex portion. When the cable end connector and the plate end connector are combined, the first magnetic member and the second magnetic member are attracted by magnetic force to be combined together.

With such configuration, the present invention achieves following technical advantages.

Compared with the previously disclosed prior arts, the present invention optimizes the structure of the connector, so as to resolve the issues of the current connector being easily affect by the antenna related factors, the deteriorated signal transmission, and the plugging operation difficulty. The present invention achieves following technical innovations. The resilient pins and the terminals of the connector are connected by contact of top points thereof, preventing the antenna effect from happening. Therefore, the application of the resilient pins and the connection terminals as the transmission carriers of the high speed connector effectively improves the signal integrity of the high speed connector. Also, the convex portion of the plate end connector is structurally provided with a 20-degree angle, so as to effectively prevent the safety issue due to an abnormally plugging or unplugging operation, such as biasedly plugging of the cable end connector and the plate end connector, from happening.

DETAILED DESCRIPTION OF THE INVENTION

The aforementioned and further advantages and features of the present invention will be understood by reference to the description of the preferred embodiment in conjunction with the accompanying drawings where the components are illustrated based on a proportion for explanation but not subject to the actual component proportion.

Referring to FIG. 1 to FIG. 6, the following detailed descriptions are provided for the purpose of illustrating embodiments of the present invention; however, the contents shall not be considered as including all the possible technical features of the present invention.

Embodiment 1

Figure 1:
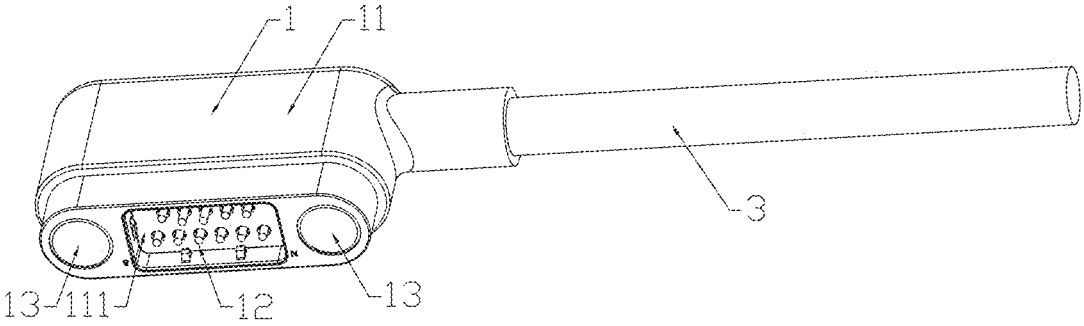
FIG. 1 is a perspective view of the cable end high speed connector with magnetic engagement mechanism in accordance with an embodiment of the present invention.
Figure 2:
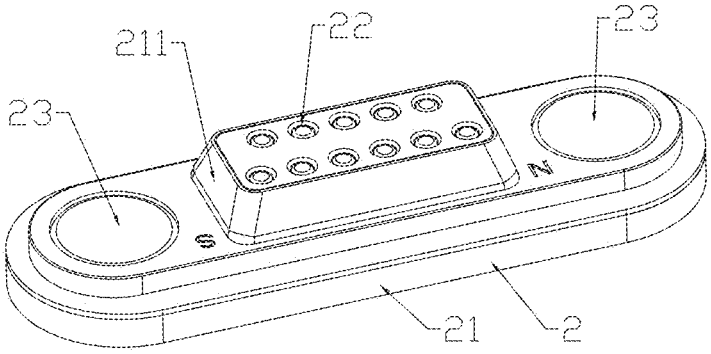
FIG. 2 is a perspective view of the plate end high speed connector with magnetic engagement mechanism in accordance with an embodiment of the present invention.
Figure 3:
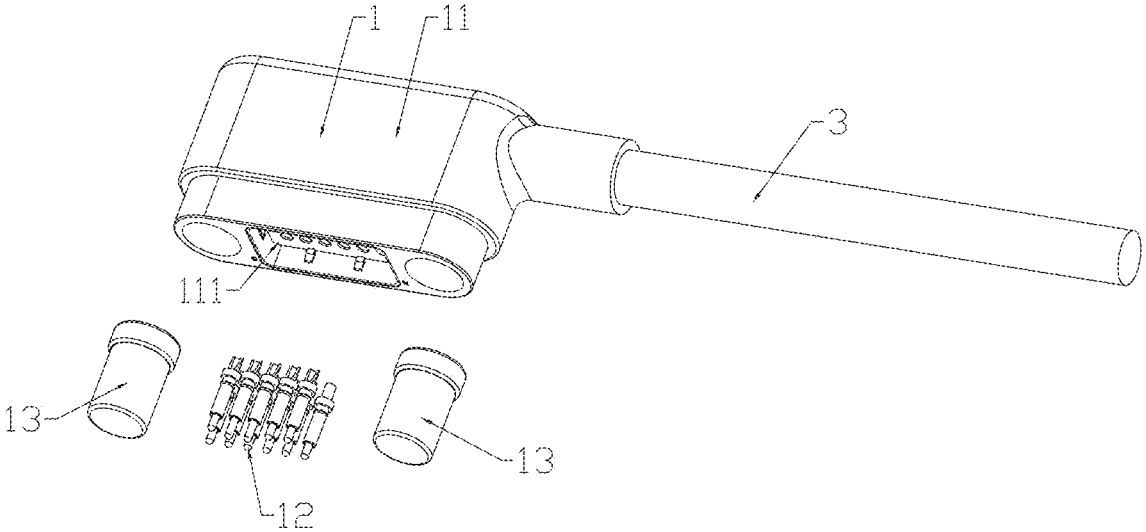
FIG. 3 is an exploded view of the cable end high speed connector with magnetic engagement mechanism in accordance with an embodiment of the present invention.
Figure 4:
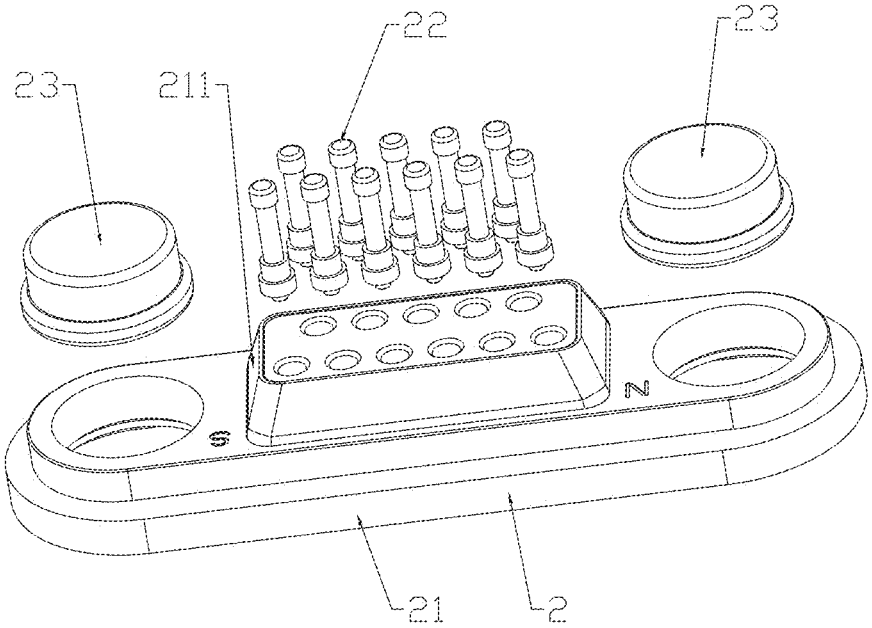
FIG. 4 is an exploded view of the plate end high speed connector with magnetic engagement mechanism in accordance with an embodiment of the present invention.
Figure 5:
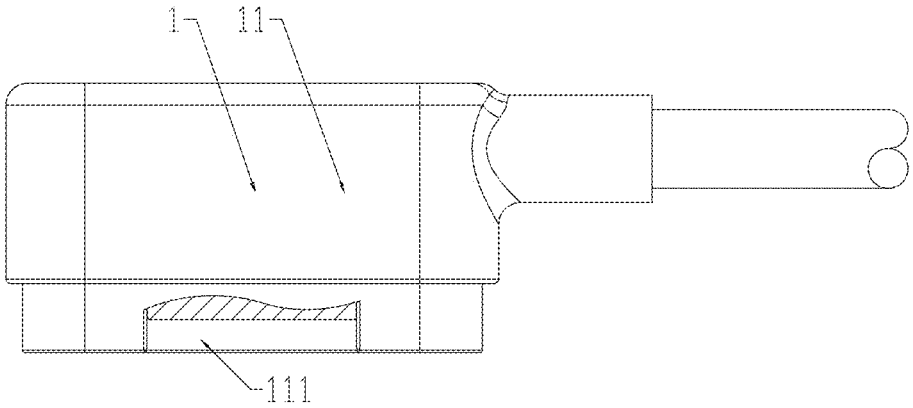
FIG. 5 is a schematic view illustrating the concave portion of the cable end high speed connector with magnetic engagement mechanism in accordance with an embodiment of the present invention.
Figure 6:
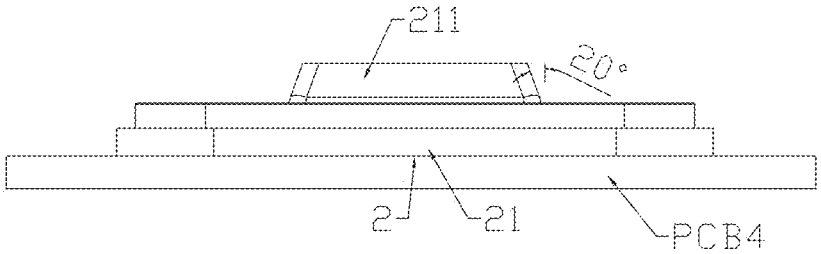
FIG. 6 is a schematic view illustrating the convex portion of the plate end high speed connector with magnetic engagement mechanism in accordance with an embodiment of the present invention.

A high speed connector with magnetic engagement mechanism is provided as shown by FIG. 1 to FIG. 4, substantially comprising: a cable end connector 1 and a plate end connector 2; the cable end connector 1 and the plate end connector 2 being combined with each other; the cable end connector 1 comprising a cable end body member 11 and a resilient pin 12 connected with a cable 3; the plate end connector 2 being disposed on a PCB (printed circuit board) 4 and comprising a plate end body member 21 and a connection terminal 22; as shown by FIG. 5, the cable end body member 11 comprising a concave portion 111 formed on a plug end of the cable end body member 11; the resilient pin 12 being disposed in the concave portion 111; as shown by FIG. 6, the plate end body member 21 comprising a convex portion 211 formed on a plug end of the plate end body member 21; the convex portion 211 and a plane of the plug end of the plate end body member 21 including a 20-degree angle; the connection terminal 22 being disposed in the convex portion 211; when the cable end connector 1 is combined with the plate end connector 2, the resilient pin 12 is inserted into the connection terminal 22.

Embodiment 2

Based on first embodiment 1, as shown by FIG. 1 to FIG. 4, the cable end connector 1 of the high speed connector with magnetic engagement mechanism comprises a first magnetic member 13 disposed on two sides of the concave portion 111, and the plate end connector 2 comprises a second magnetic member 23 disposed on two sides of the convex portion 211. When the cable end connector 1 and the plate end connector 2 are combined, the first magnetic member 13 and the second magnetic member 23 are attracted by magnetic force to be combined together.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A high speed connector with magnetic engagement mechanism comprising:

a cable end connector and a plate end connector; the cable end connector and the plate end connector being combined with each other;

the cable end connector comprising a cable end body member and a resilient pin connected with a cable;

the plate end connector being disposed on a PCB and comprising a plate end body member and a connection terminal;

the cable end body member comprising a concave portion formed on a plug end of the cable end body member;

the resilient pin being disposed in the concave portion;

the plate end body member comprising a convex portion formed on a plug end of the plate end body member;

the convex portion and a plane of the plug end of the plate end body member including a 20-degree angle;

the connection terminal being disposed in the convex portion; such that when the cable end connector is combined with the plate end connector, the resilient pin is inserted into the connection terminal.

2. The high speed connector of claim 1, wherein the cable end connector of the high speed connector comprises a first magnetic member disposed on two sides of the concave portion, and the plate end connector comprises a second magnetic member disposed on two sides of the convex portion; when the cable end connector and the plate end connector are combined, the first magnetic member and the second magnetic member are attracted by magnetic force to be combined together.

* * * * *